US012709906B2

(12) United States Patent
Morton et al.

(10) Patent No.: US 12,709,906 B2
(45) Date of Patent: Aug. 18, 2026

(54) SYSTEM AND METHOD FOR BUILDING LAYOUT

(71) Applicants: Brenden Morton, Arcata, CA (US); Mark Mendez, Firestone, CO (US); Ross Huber, Garberville, CA (US); Chad Ziesemer, Oshkosh, WI (US)

(72) Inventors: Brenden Morton, Arcata, CA (US); Mark Mendez, Firestone, CO (US); Ross Huber, Garberville, CA (US); Chad Ziesemer, Oshkosh, WI (US)

(73) Assignee: UPRIGHT LLC

( * ) Notice: Subject to any disclaimer, the term of this patent is extended or adjusted under 35 U.S.C. 154(b) by 954 days.

(21) Appl. No.: 17/983,201

(22) Filed: Nov. 8, 2022

(65) Prior Publication Data

US 2023/0146386 A1 May 11, 2023

Related U.S. Application Data

(60) Provisional application No. 63/277,312, filed on Nov. 9, 2021.

(51) Int. Cl.
*E04G 21/18* (2006.01)

(52) U.S. Cl.
CPC ..... *E04G 21/1833* (2013.01); *E04G 21/18* (2013.01)

(58) Field of Classification Search
CPC ..... E04G 21/18; E04G 21/1833
USPC ..... 33/1 G, 293, 294, 295, 296, 404, 405
See application file for complete search history.

(56) References Cited

U.S. PATENT DOCUMENTS 2,916,827 A * 12/1959 Steindel ..... G01B 3/04 33/294
2,981,000 A * 4/1961 Long ..... G01C 15/06 33/1 H
4,095,343 A * 6/1978 McPhail ..... E04G 21/1833 33/286
4,924,579 A 5/1990 Berendsen
5,189,484 A * 2/1993 Koschmann ..... G01C 15/006 250/208.2
6,166,802 A * 12/2000 Kodaira ..... G01C 15/006 356/400

(Continued)

FOREIGN PATENT DOCUMENTS

CA 3086133 A1 * 1/2022 ..... E04G 21/1833

OTHER PUBLICATIONS

U.S. Appl. No. 68/171,041, filed Nov. 16, 2004, Rabalais, Jr.

(Continued)

*Primary Examiner* — George B Bennett
(74) *Attorney, Agent, or Firm* — American Law LTD; Ian Burns; Darren Gardner

(57) ABSTRACT

A system for building layout includes a moveable marking device that can be placed on vertical batter boards and remotely controlled into a position on the batter board to indicate the height of a top of a building foundation. The moveable marking device may also be placed on horizontal batter boards and remotely controlled into a position to indicate a position on the horizontal batter board where an extension of a building edge intersects the horizontal batter board. The moveable marking device may also be placed on foundation form boards and remotely controlled to indicate a position on the form board that relates to the location of a feature in the building.

23 Claims, 15 Drawing Sheets

SYSTEM OVERVIEW

(56) References Cited

U.S. PATENT DOCUMENTS 6,415,518 B1 * 7/2002 Sims ..... E04G 21/1833 33/1 G
6,490,803 B1 * 12/2002 Butters ..... E04G 21/1833 33/405
6,508,006 B1 * 1/2003 Black ..... G01C 15/06 33/293
6,760,974 B1 * 7/2004 Jorgenson ..... G01C 15/004 33/526
7,611,105 B1 * 11/2009 Carazo ..... G01C 15/06 33/286
7,624,508 B2 * 12/2009 Beck ..... E04G 21/1808 33/408
8,201,340 B2 * 6/2012 Steffensen ..... G01C 15/06 33/809
8,567,076 B2 * 10/2013 Ortleb ..... G01C 15/06 33/228
8,712,721 B2 * 4/2014 Hamel ..... G01C 15/02 33/291
9,003,672 B2 * 4/2015 Lozano, IV ..... F24S 25/00 33/408
9,541,392 B2 * 1/2017 Dusha ..... G01C 15/06
10,054,440 B2 * 8/2018 Egan ..... E04G 21/00
11,927,302 B2 * 3/2024 Ritter ..... F16M 13/022
2007/0089312 A1 4/2007 Wade
2012/0240513 A1 9/2012 Miller
2013/0269197 A1 * 10/2013 Collins ..... E04G 21/1833 33/405
2015/0030712 A1 1/2015 Mccaffrey
2023/0106808 A1 * 4/2023 Achard ..... G01C 15/006 33/1 G
2023/0152095 A1 * 5/2023 Sato ..... G01C 15/002 116/209
2023/0272632 A1 * 8/2023 Nishi ..... G01C 15/002 33/405
2023/0280156 A1 * 9/2023 Jaerleberg ..... E04G 11/06 33/301

OTHER PUBLICATIONS

Sestras "Methodological and on-site applied constraction layout plan and batter boards stake-out methods comparison: A case study of Romania." Applied Sciences 11.10 (2021).

* cited by examiner

SYSTEM AND METHOD FOR BUILDING LAYOUT

CROSS REFERENCE TO RELATED APPLICATIONS

This application claims priority to U.S. Provisional Application Ser. No. 63/277,312 filed 9 Nov. 2021, the entire contents of which are herein incorporated by reference.

FIELD OF THE INVENTION

The present invention relates a system, device and method for facilitating the layout of a building and/or the sites of components, fixtures and features within a building.

BACKGROUND OF THE INVENTION

Foundation layout for the construction of a building can be a time consuming process. It is imperative that batter boards that mark the heights of a foundation are placed accurately and that the building edge projections are accurately marked on the batter boards to enable the boundaries of the foundation to be followed during construction of the foundation. Setting these heights and edges can be a painstaking process with many iterations. What is required is an improved system and method that can increase the accuracy and/or efficiency of the building layout process.

SUMMARY OF ONE EMBODIMENT OF THE INVENTION

Advantages of One or More Embodiments of the Present Invention

The various embodiments of the present invention may, but do not necessarily, achieve one or more of the following advantages:

- the ability to quickly mark out a building foundation;
- provide improved accuracy in building foundation layout;
- reduce the number of people required to set out a building foundation;
- provide an ability to mark out installation features within a building; and
- provide an automated device that can be controlled into positions for marking out features of a building.

These and other advantages may be realized by reference to the remaining portions of the specification, claims, and abstract.

BRIEF DESCRIPTION OF ONE EMBODIMENT OF THE PRESENT INVENTION

In one aspect of the present invention, there is provided a method for building foundation layout. The method may comprise locating at least one moveable device onto a vertical batter board and providing a first guidance signal from a control unit to the at least one moveable device to move the at least one moveable device to indicate a height of a top of a building foundation. The at least one moveable device may be located onto a horizontal batter board placed on the vertical batter board in alignment with the indicated height of the top of the building foundation. A second guidance signal to the at least one moveable device may move the at least one moveable device to indicate a position on the horizontal batter board where an extension of a building edge intersects the horizontal batter board.

In one aspect of the present invention, there is provided a moveable device for use in laying out a building foundation. The moveable device may comprise one or more guides for locating the moveable device on a batter board. A motor may drive the one or more guides to cause the moveable device to move along the batter board. At least one control unit may receive guidance signals and control the motor in response to the guidance signals.

In one aspect of the present invention, there is provided a system for building foundation layout. The system may comprise a control unit and one or more moveable position indicating devices that can be deployed onto batter boards located on a building site. The moveable position indicating devices may be located onto a vertical batter board and receive a first guidance signal from the control unit that moves the device along the vertical batter board to a position that indicates a height of a top of a building foundation. The device may be located onto a horizontal batter board placed on the vertical batter board in alignment with the indicated height of the top of the building foundation and receive a second guidance signal from the control unit. The second guidance signal moves the device along the horizontal batter board in response to the second guidance signal to a position on the horizontal batter board that indicates where an extension of a building edge intersects the horizontal batter board.

In one aspect of the present invention, there is provided a moveable device for use in laying out a building foundation. The moveable device may comprise guide means, motor means and signal means. The guide means may be for locating the moveable device on a batter board. The motor means may be for driving the guide means to cause the moveable device to move along the batter board. The signal means may be for receiving guidance signals and controlling the motor means in response to the guidance signals.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

Figure 1:
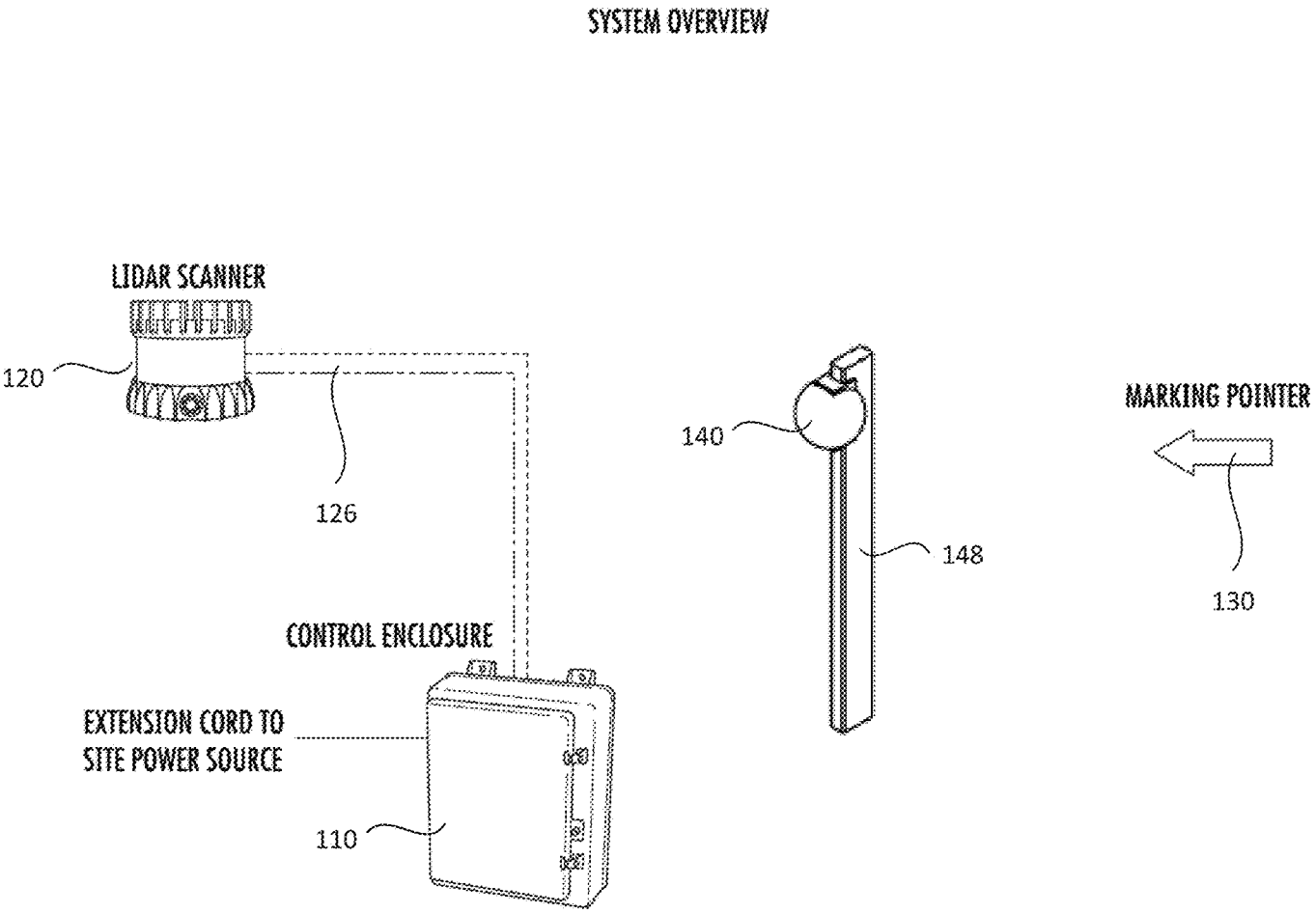
FIG. 1 substantially depicts a schematic of a system for building layout in accordance with an embodiment of the present disclosure.

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

In general, the concept to be described uses a scanning system to generate an accurate point cloud representation of a building pad or closed in building. The scanning system may be a LIDAR scanning array, camera and photogrammetry software, or a combination of such systems. A digital building design can be overlaid and merged with the point cloud and used to calculate the position of each corner of the building foundations. A laser pointer or augmented reality application at the foundation site, e.g. as part of the LiDAR scanning array, can be used to indicate the physical location of the corners of the building on the building pad. Vertical batter boards can be accurately placed in the vicinity of the corners. Once the vertical batter boards are placed, a re-scan of the building site takes place and the resulting point cloud including the vertical batter boards is synced with the digital design, so that the vertical batter boards are also represented in this merged model. Controlled moveable devices are then placed on each vertical batter board and directed by guidance instructions to move to a point where a level plane indicating the top of the foundation is indicated. Then, horizontal batter boards will be attached to the vertical boards at the level indicated. Next the same type of moveable device will be mounted on the horizontal batter boards and directed to move into the location that represents locations where the extension of each building edge meets the batter board. The use of controlled devices to indicate and accurately locate the top of the building foundation and the points where the extension of each wall edge meets the horizontal batter boards will speed and simplify the layout process and deliver a greater degree of accuracy and certainty. The same or a similar process can be used to layout interior walls and locations of other elements, such as mechanical, plumbing, electrical and media fixtures and lines. Additionally, having a digital representation of the existing physical amenities can provide a platform for use by additional autonomous equipment during construction and/or the operator of the building once the construction phase is completed.

The process described above utilizes a scanning system resulting in a static pointcloud representation of a building pad. Alternatively, the system may utilize dynamic sensor inputs from multiple live sensors distributed across the building pad. In this embodiment, when the batter boards are placed, the batter boards can be almost instantly merged into the model due to the live scanning by the sensors.

FIG. 1 shows the components of a system for marking a building layout in accordance with an embodiment of the invention. The system 100 includes a control unit 110 containing control electronics, communications modules, power electronics and ancillary components for controlling the other components of the system. The control unit may include a power port and/or power cable for connecting to a source of mains power. Alternatively or in addition, the control box may include an internal battery. The battery may be rechargeable, including solar rechargeable. Within the control unit 110 there may be a transformer that converts mains power to 24V DC power. DC power may be distributed from the control unit 110 to other powered elements of the system as will be described below.

The control electronics may include at least one processor and at least one memory operatively associated with the at least one processor. The at least one memory may include at least one read only memory (ROM) for storing programs, apps, code, data, etc. The at least one memory may also include at least one random access memory (RAM) for use in executing programs, apps, code, etc. The control unit 110 may include connections to the other components of the system. The connections may include physical electrical connections, data connections, wireless connections (e.g. via the communications modules) etc. In one embodiment, the control unit 110 may be a mobile computing device, such as a mobile telephone, laptop, tablet, iPad, etc.

The system 100 further includes a scanning system 120. As mentioned above, the scanning system may utilize at least one LIDAR scanner, photogrammetry or a combination of such systems. In a LIDAR embodiment, the LiDAR scanner is able to transmit low powered laser signals across an area. Reflected signals can be received into the LiDAR scanner 120 and transmitted to the control unit 110 for processing into a 3-D representation of an area. The LiDAR scanner 120 may be connected to the control unit 110 by cabling 126, including a data cable (e.g. ethernet) and/or a power cable. Power and signals may be conveyed between the control unit 110 and the LiDAR scanner 120 through this cabling. In alternative embodiments, the LiDAR scanner 120 may include its own power supply, e.g. battery power or connection to mains, and may communicate with the control unit 120 through wireless protocols such as Bluetooth or WiFi, or other wireless methods as commonly applied to IoT devices. In one embodiment, the scanning system may be incorporated into the computing device. For example, a mobile device such as a tablet, iPad, mobile telephone etc. may be utilize its camera functions to perform photogrammetry at the building site.

The system 100 further includes at least one marking pointer 130. The marking pointer may be a laser pointer, an augmented reality application, or other device(s) that allow specific locations on the building pad to be accurately indicated. The system 100 further includes at least one moveable device 140 disposed on a vertical batter board 148. The moveable device 140 may include a motor, such as a stepper motor or servo motor, a power source such as a battery or power port for external power connection, and a communications module for receiving control signals from the control unit 110. The device 140 may be configured for wired or wireless communications with the control unit 140. Specific embodiments of the moveable device 140 will be described in detail below. The device 140 may include at least one fiduciary marker that can be used to provide a physical reference point and an indicator. The indicator may include a visible indicator, such as a beacon or similar light. The indicator may also include an audible indicator, such as an alarm that is capable of producing different tones or sounds to indicate a number of different statuses.

Figure 2:
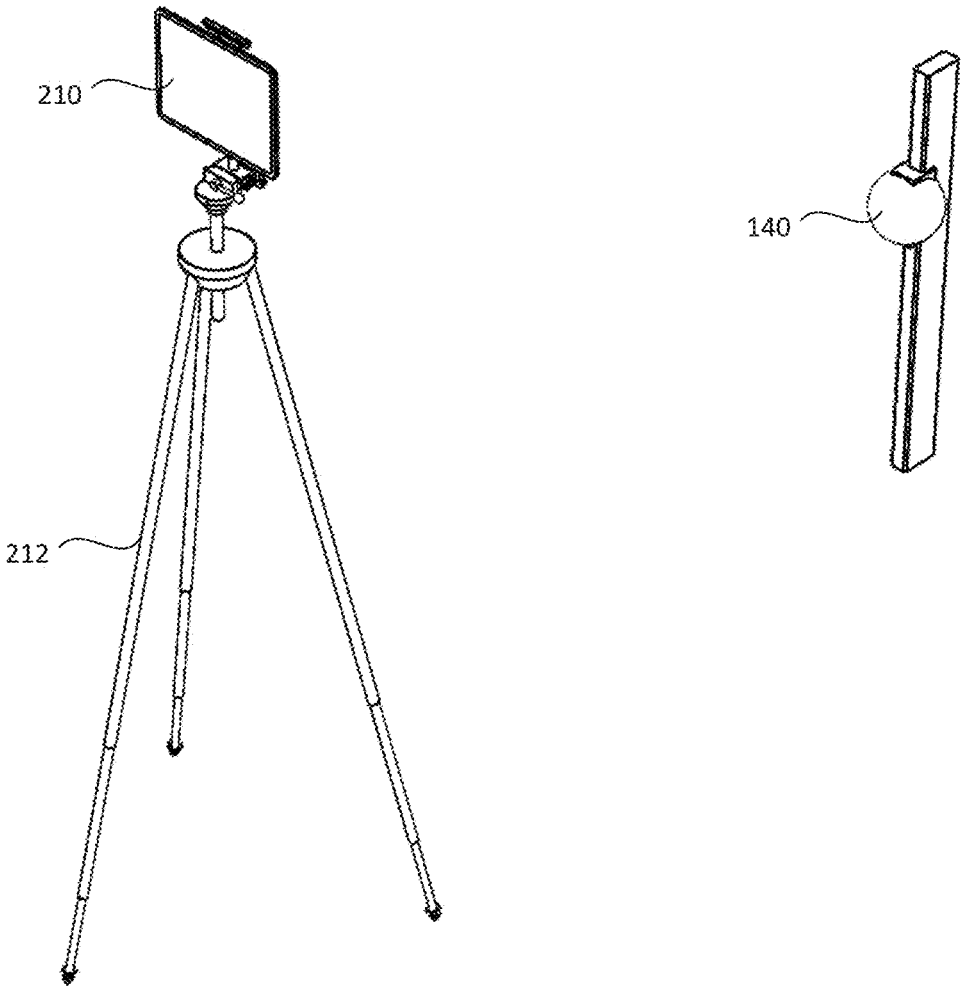
FIG. 2 substantially depicts a specific embodiment of the system of FIG. 1.

A specific embodiment of the system 100 is depicted in FIG. 2. In FIG. 2, the control unit 210 may include a mobile device such as a tablet or iPad supported on a stand 212. The mobile device 210 may have camera features and software that are able to perform photogrammetry by taking multiple photographs across the site and constructing a digital model of the site. The mobile device 210 may also be programmed with augmented reality software that is able to provide guidance in place of a laser pointer for indicating the corners of buildings. The mobile device 210 may be able to communicate with the moveable device 240.

The system of FIG. 1 may be used at various locations of the physical site to create a scaled point cloud of the location, which is then merged with a digital building design. Multiple scans or digital photographs are taken across the site and then merged into a single point cloud that is scaled and represents the building site digitally. Typically, only one scanner or camera device is needed, though additional scanners and operators could be used to speed the process. Only one laser pointer or augmented reality device would also be needed, though more could be used to speed the process. The scanners would be placed or held at various locations around the physical site to accurately capture the physical features of the site (known as reality capture) and then required locations are calculated. Then the laser pointer or augmented reality device would be used to indicate approximate locations of building features (foundation corners, etc.) so that batter boards can be placed in the correct adjacent locations. Precise indication of the corners is not essential at this stage. Once vertical batter boards are placed, the area is re-scanned and the new scan is merged with the digital building plans again so that the vertical batter boards are also shown in the blended model. Then the actuator device is placed on the vertical batter board and it moves along it so as to indicate the exact location of the level at the top of the foundation so that horizontal batter boards can be placed at that level. Once those are placed, the actuator device is set up on the horizontal batter boards so the locations where the extension of each building edge meets the horizontal batter board can be indicated.

Figure 3:
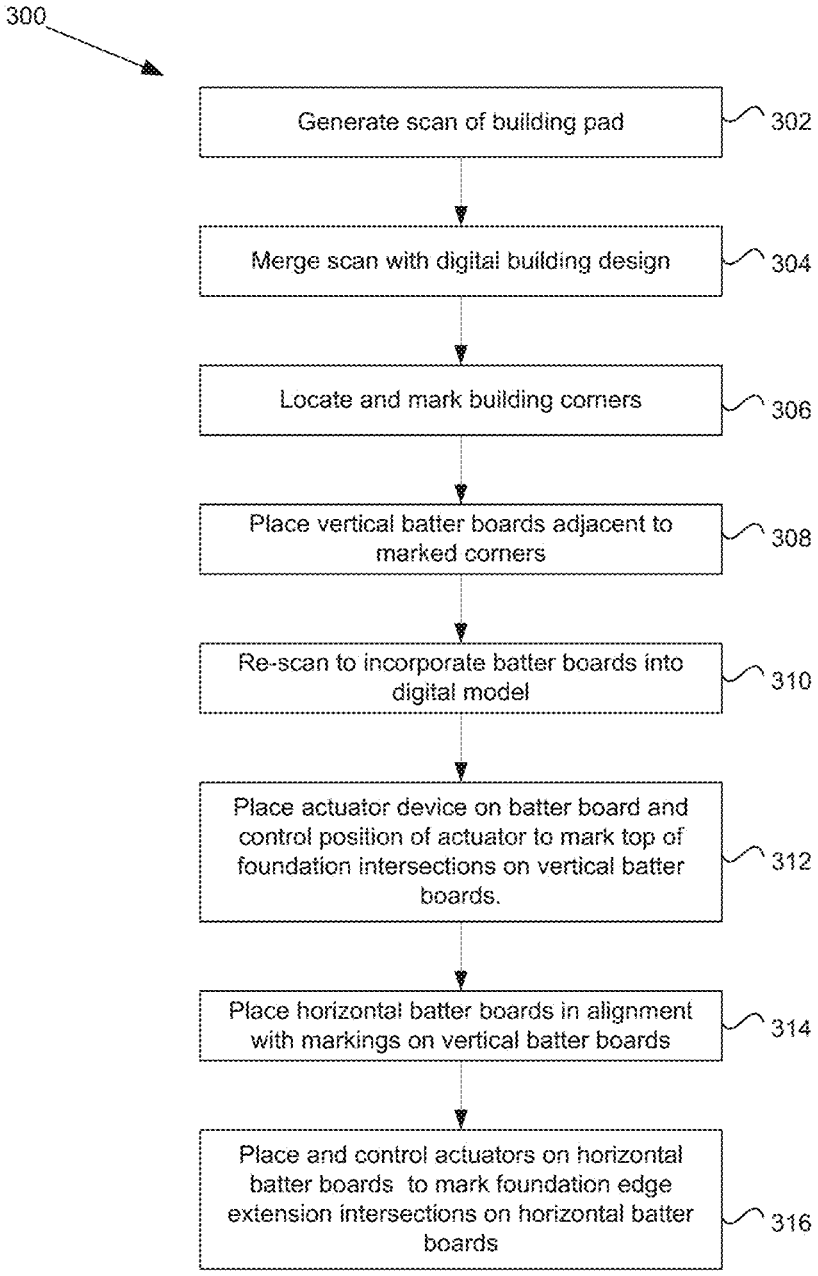
FIG. 3 substantially depicts a building layout method.

FIG. 3 shows a flowchart 300 of a building layout method in accordance with an embodiment of the invention. At step 302, a scan of a building pad is undertaken. In one embodiment, the scan may be performed using LIDAR scanner(s) to generate a pointcloud representation of the building pad. In another embodiment, sensors may be placed at appropriate locations around the building pad. At step 304, a digital building model can be merged with the pointcloud data or live sensor data to create a digital building layout. At step 306, the digital building layout is utilized to indicate the corners on the physical building site, e.g. utilizing a laser pointer(s) or augmented reality. Vertical batter boards can be placed adjacent the corners on the building site (step 308) and the building site re-scanned to incorporate the vertical board placement into the digital building layout (step 310). Third party applications (potentially blending LiDAR and photogrammetry capabilities) may be used to generate and update the point cloud representation of the building site, which is merged with the digital design of the building to then drive the layout process. Fiducial markers may be used to assist in scaling size/distance in the generation/updating of the point cloud representation of the building site, to increase accuracy and precision.

At step 312, the moveable actuator device 140 is placed onto a vertical batter board and controlled, using the control unit 110/210 in conjunction with the digital building layout data, to locate and mark the top of foundation intersections on vertical batter boards. This step can be repeated for each of the vertical batter boards on the building site. At step 314, horizontal batter boards can be placed on the vertical boards at the heights marked in step 312. The device 140 can then be placed on the horizontal batter boards and controlled to indicate where the foundation edge extension intersection the horizontal batter boards (step 316).

Once the process has begun and a digital representation of the building site has been created, if the sensors dispersed on the site need to be moved, they do not need to be replaced in the same locations, as the point cloud can be automatically registered based on the locations of landmarks/features in the scene.

Figure 16:
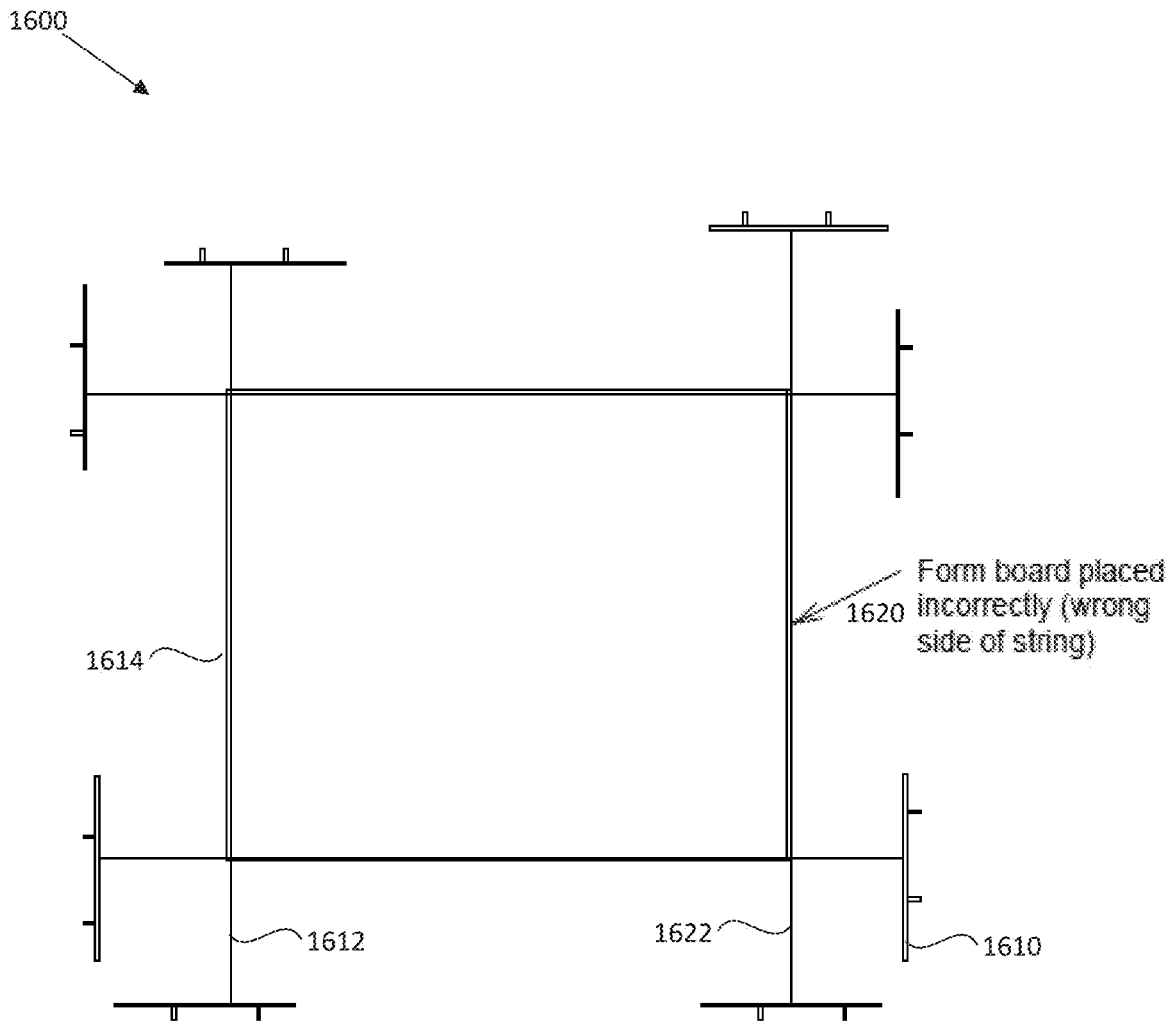
FIG. 16 substantially depicts a building site scan that can capture errors in the placement of foundation form boards.

The locations of batter boards and other components, such as foundation form boards once they have been placed, can be checked for accuracy and adherence to the plan, using the same sensors and software systems that were used to create and drive the layout. FIG. 16 shows a rescan 1600 of a building site once batter boards 1610, string lines 1612, form boards 1614 and any other layout features have been placed. In this example, a comparison of the scan 1600 to a digital building layout reveals that the board 1620 has been placed on the wrong side of the string line 1622. Rescanning the building site once form boards and other elements are placed and comparing the live site to the digital plans can catch errors ahead of concrete being poured and allow any necessary adjustments and rectifications to be made.

Figure 4:
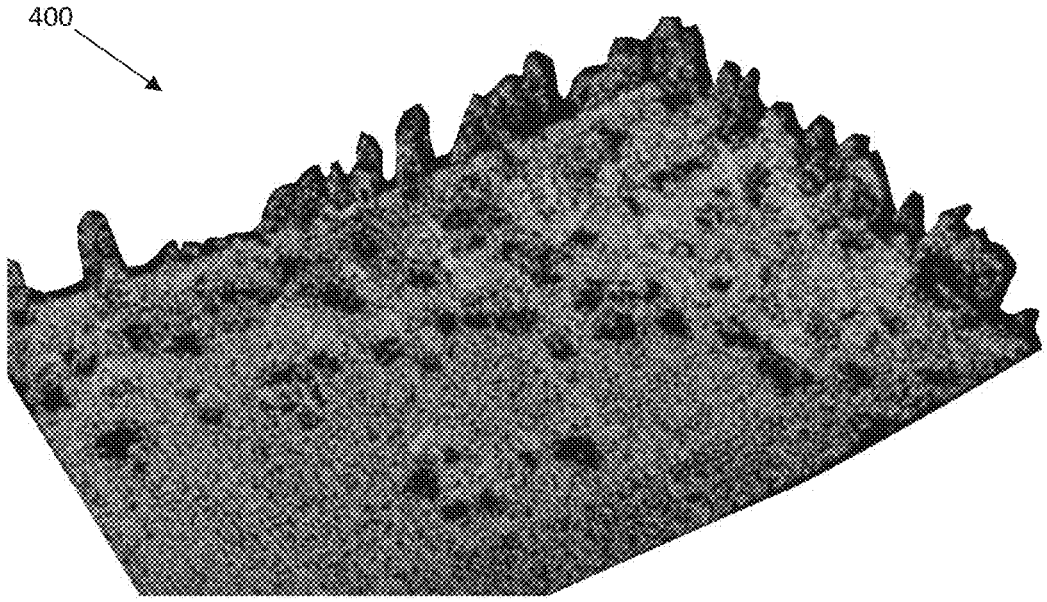
FIG. 4 substantially depicts a pointcloud representation of a building site.
Figure 5:
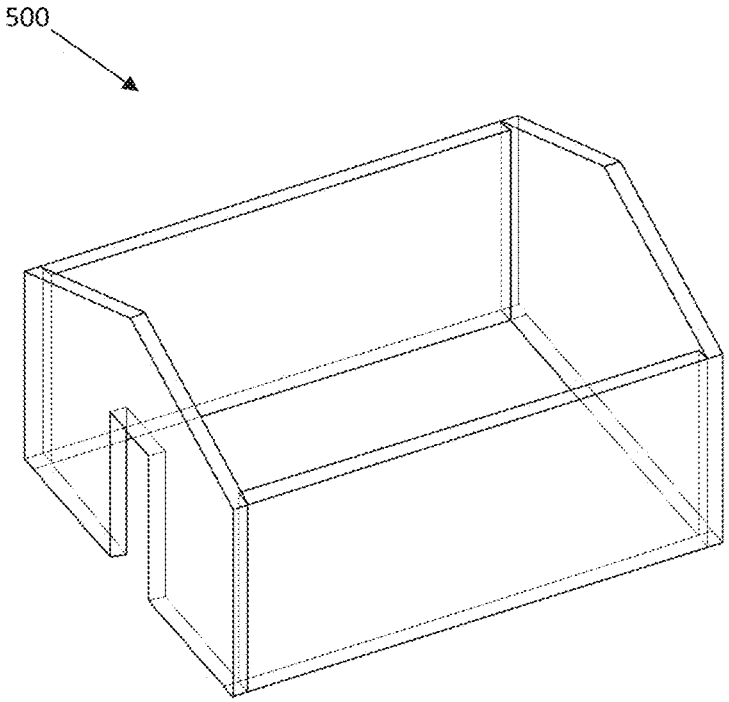
FIG. 5 substantially depicts a digital representation of a building.
Figure 6:
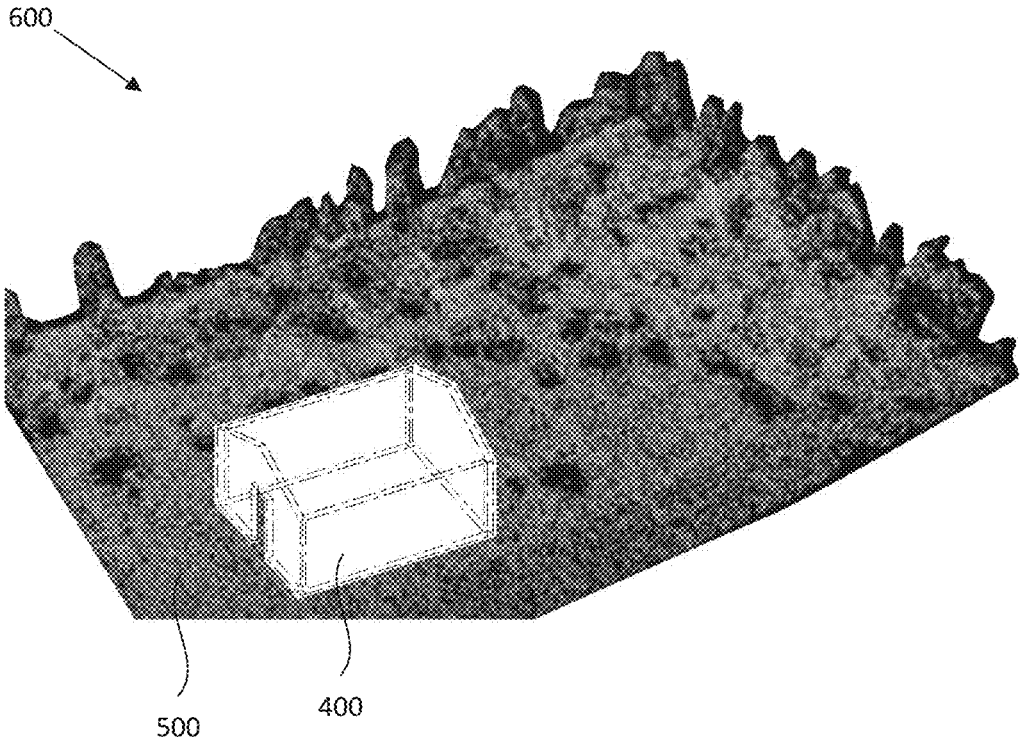
FIG. 6 substantially depicts the digital building overlaid on the pointcloud representation.
Figure 7:
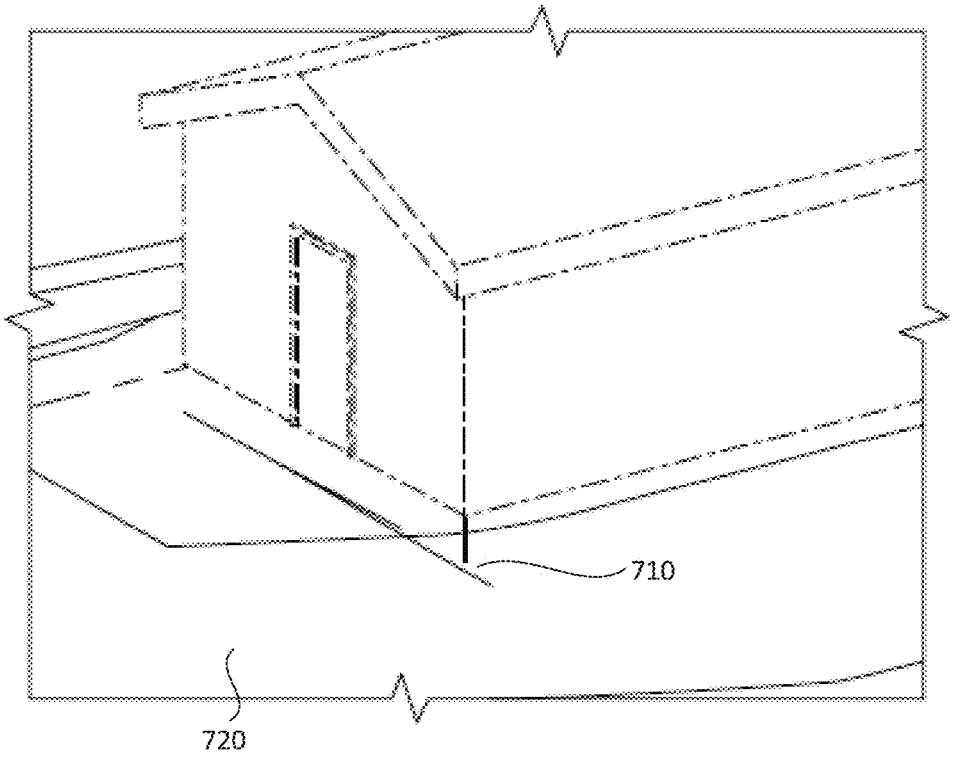
FIG. 7 substantially depicts a method step of indicating corners of a building on a building site.
Figure 8:
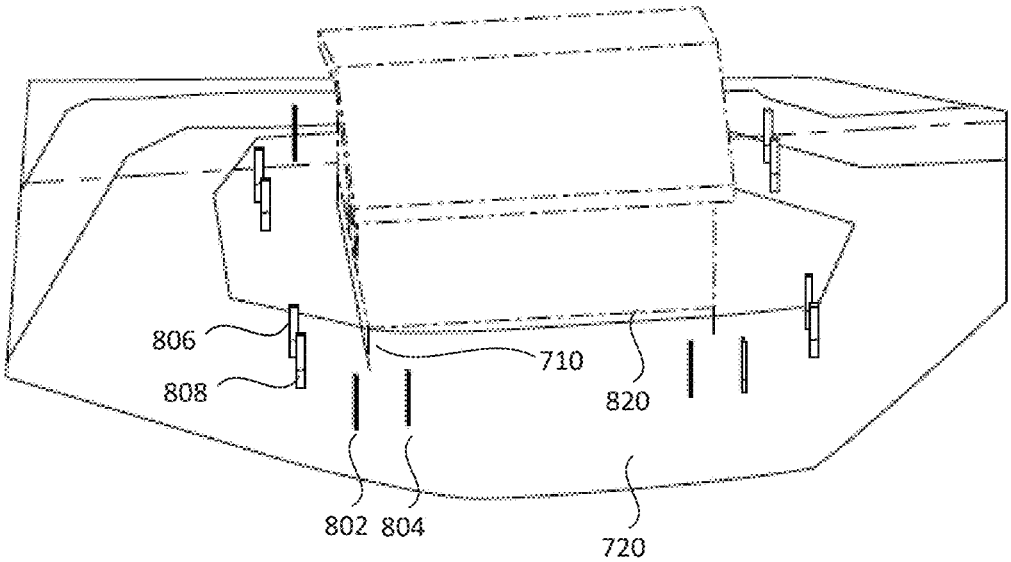
FIG. 8 substantially depicts a method step of locating vertical batter boards adjacent the proposed building corners of the building site.

FIG. 4 shows an example of a pointcloud representation 400 of an area that may be produced from the scanning system 120. FIG. 5 shows a digital 3-D representation 500 of a building design. FIG. 6 shows an overlay 600 in which the digital building design 500 has been overlaid and merged with the pointcloud representation 400. Using this overlay, the physical location of elements of the building design can be calculated. In particular, the corners of the building required for the foundations can be calculated as a series of data points, e.g. as GPS coordinates, latitude/longitude, as points at calculated locations relative to other visible features in the physical area, etc. At the building site, the control unit can communicate the coordinates of the corners to the laser pointer and control the laser pointers to point at the corners of the building 710 on the ground 720 (FIG. 7). An augmented reality, e.g. displayed on a tablet, can also be used to indicate the corners 710. Pinpoint precision of the building corners is not essential at this stage. Adjacent each corner 710, vertical batter boards may be installed. As shown in FIG. 8, each corner 710 includes four vertical batter boards. A first set of two batter boards 802, 804 are located either side of the corner in a first direction (e.g. the x-coordinate) and a second set of batter boards 806, 808 are located either side of the corner in an orthogonal direction to the first direction (e.g. the y-coordinate). Each set of batter boards are located outwards of the building footprint 820 on the ground 720 at the building site. Once the vertical boards are placed, the site may be re-scanned and the vertical boards incorporated into the digital building model. In one embodiment, fiducial marker codes specific to each batter board can be generated and associated with each vertical/horizontal batter board. A sticker or similar marker may be placed on the batter board with that code on it to be read by the sensor, so that that batter board can be correctly identified and correlated to the correct location in the digital model. For example, each of the vertical batter boards can be assigned a number, V1-V16, and a specific fiducial code, similar to a QR code can be printed on a sticker and applied to the corresponding batter board. Then the sensor can read that code on the batter board and the software can select the correct batter board in the model and direct the actuator device to indicate the correct location representing top of foundation level as it intersects the vertical batter board. The same process can be repeated for horizontal batter boards and the locations where building edge extensions intersect the batter boards.

Figure 9:
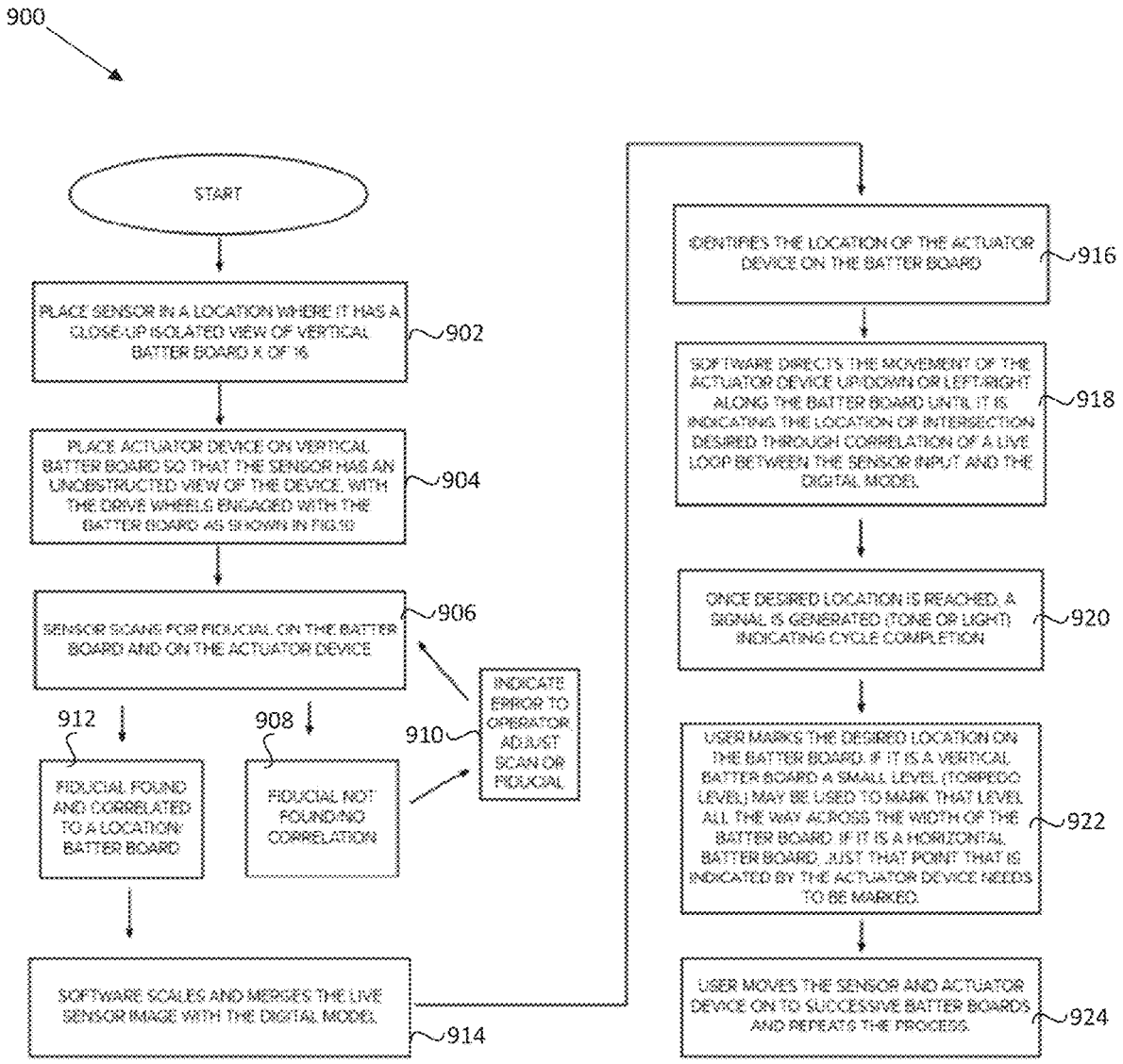
FIG. 9 substantially depicts a method using the system of FIG. 1 to indicate the height of the building foundation on the vertical batter boards.

A method 900 for using the system 100 including control unit 110 and moveable actuators 140 to indicate the top of a building foundation will now be described with reference to FIG. 9. The method 900 assumes that vertical batter boards are in place on site as shown in FIG. 8 and have been scanned into the digital building model. The method 700 also relates specifically to the embodiment of the system 100 shown in FIG. 2 in which a sensor, such as the camera of tablet 210, is able to sense the position of and communicate with the moveable actuator device. The method starts at 902 by placing the sensor in a location where it has a close up isolated view of vertical batter board x of 16 (the number 16 assumes a generally rectangular building pad with four vertical boards at each of four corners. A greater or lesser number of corners and vertical boards may be deployed. At step 904, an actuator device 140 is placed on a vertical batter board, e.g. board 802, so that the sensor has an unobstructed view of the device 140. At 906, the sensor scans for any fiducial or reference marker on the batter board and/or on the actuator device. If no correlation can be found 908 then the sensor indicates an error to the operator 910 to enable any adjustments to be made. Once a fiducial is found the actuator may be correlated to a location on the batter board 912. The sensor software can then scale and merge the live sensor image with the digital model 914. FIG. 9 of original patent application #906 the fiducial marker mentioned can be used to indicate the specific batter board that is being scanned, or there may be other methods of indicating that as well, such as QR codes, bar codes and/or sequential numbering. There may also be a fiducial marker placed on the actuator device to assist with distance/size scaling in the scanner's field of view, and to assist with the moving of the actuator into the correct location to indicate the desired junction point or location (junction of top of foundation with vertical batter board, or junction with extension of building/foundation edge with horizontal batter board, or location of other building component, such as drain lines or electrical conduit)

At step 916, the sensor identifies the location of the actuator on the batter board. Software that is able to read the digital building model and the current position of the actuator then directs the movement of the actuator along the batter board until the actuator is indicating the location of the intersection desired (step 918). For a vertical batter board, the actuator will be moved up/down the batter board until the actuator marks the point on the batter board that intersects with the top of the foundation. The actuator and/or sensor may activate a signal 920 (audible, visible or both) to indicate that the location cycle of the actuator is complete. The user, e.g. builder, contractor, etc., marks the desired location on the board 922, or alternatively the actuator may carry a marking system and mark the location without manual input. For a vertical board, a level may be used to mark the foundation height across the width of the board. The user then moves the sensor and actuator onto the next batter board 924 and the process is repeated.

Figure 10:
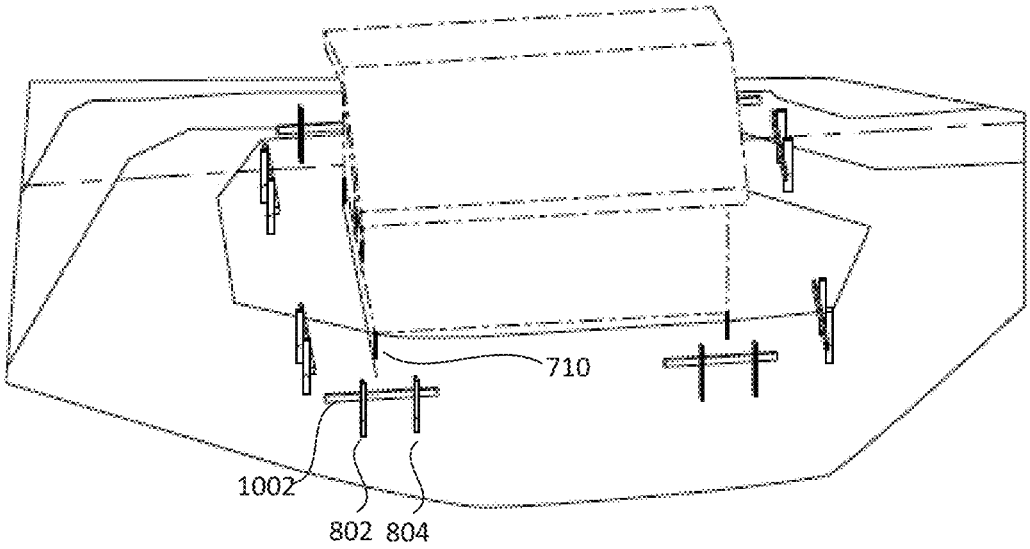
FIG. 10 substantially depicts a method step of locating horizontal batter boards to mark the height of a building foundation.

Once the vertical batter boards have all been marked, horizontal batter boards can be placed across that brace each pair of batter boards. The top of the horizontal batter boards mark the height of the top of the building foundation, e.g. for a subsequent concrete pour or other creation of the building foundation. FIG. 10 shows the building site after placement of horizontal batter boards 1002 at each corner.

Figure 11:
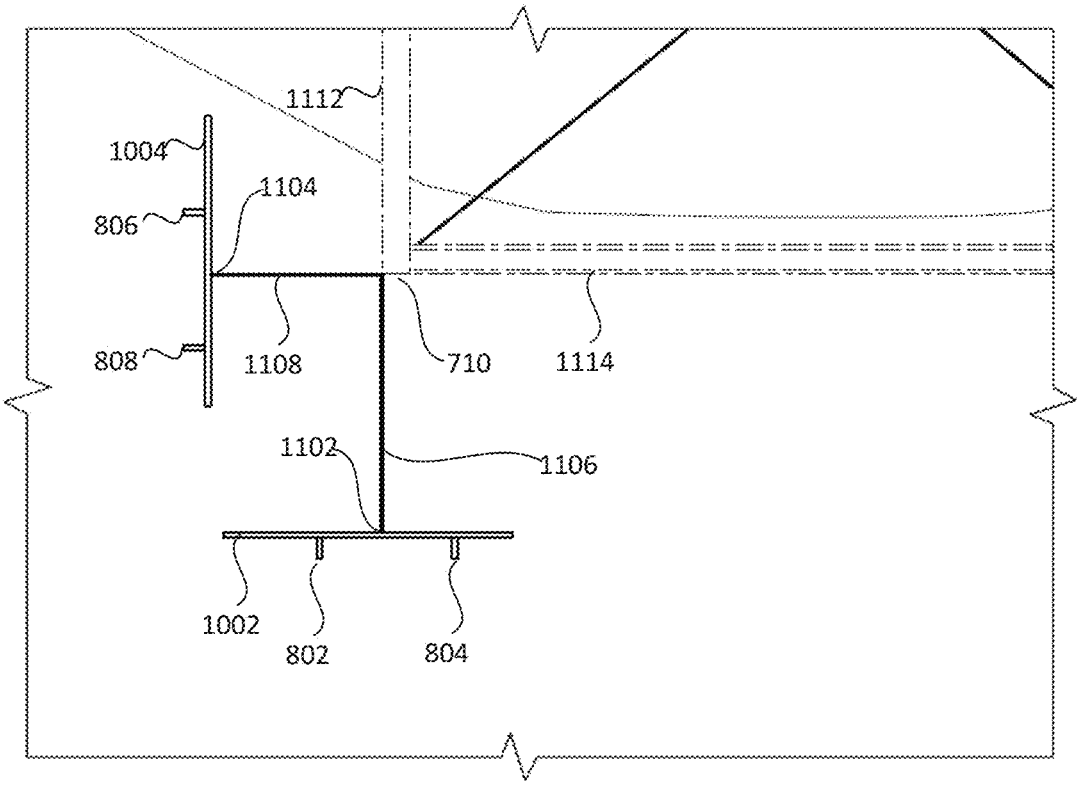
FIG. 11 substantially depicts a method step of marking building wall projections onto the horizontal batter boards.

The actuator can be placed on the horizontal boards 1002 and the sensor placed in view of the actuator to enable guidance of the actuator on the horizontal boards. The method 900 can then be repeated on the horizontal boards to locate and mark the corner projections 1102, 1104 onto each of the horizontal batter boards 802, 804 (FIG. 11). That is, the actuator can receive guidance commands from the control sensor that cause the actuator to move into the location that represents the location where the extension 1106, 1108 of each building edge 1112, 1114 meets the respective horizontal batter board 1002, 1004.

Figure 12:
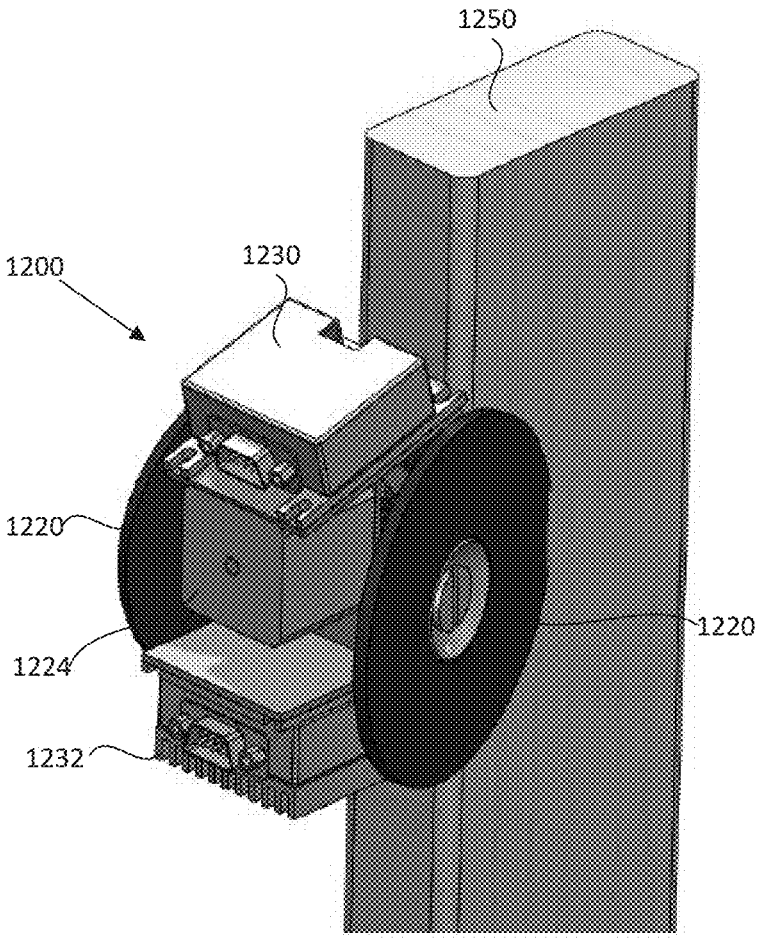
FIG. 12 substantially depicts a perspective view of an actuator for traversing batter boards.
Figure 13:
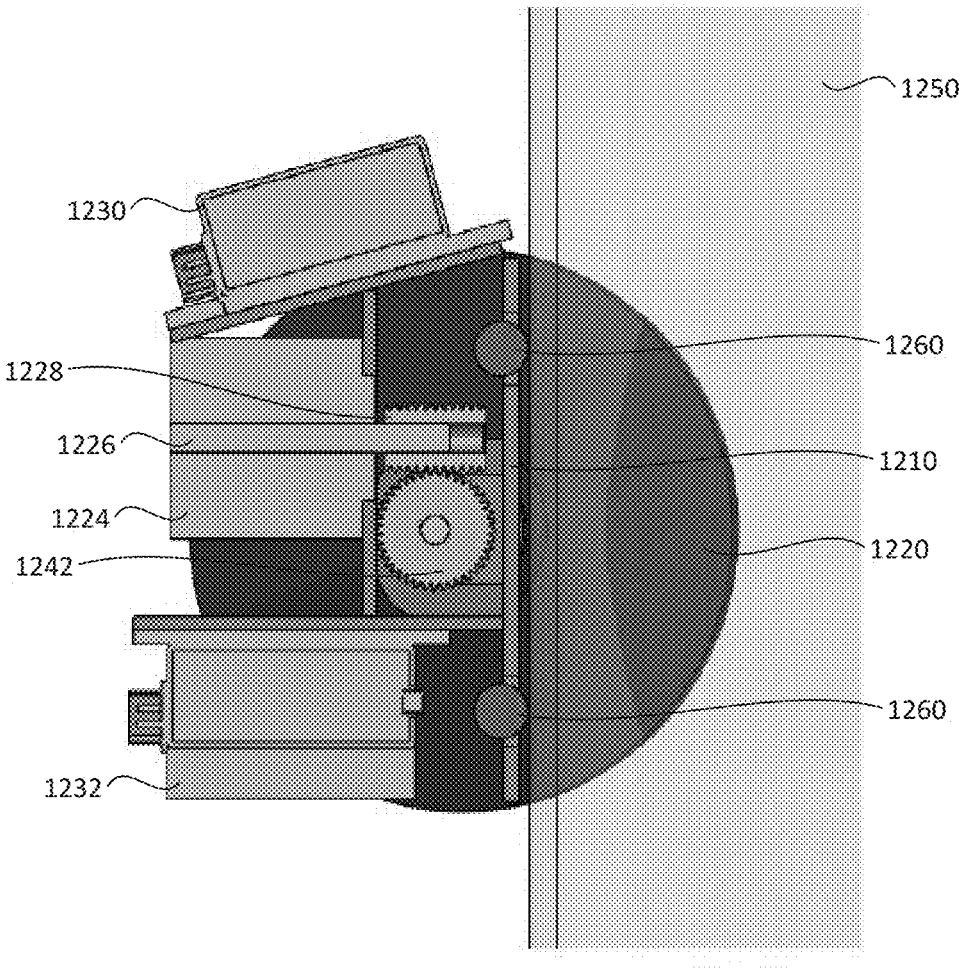
FIG. 13 substantially depicts a side view of the actuator of FIG. 12 with a near-side removed to show internal components of the actuator.
Figure 14:
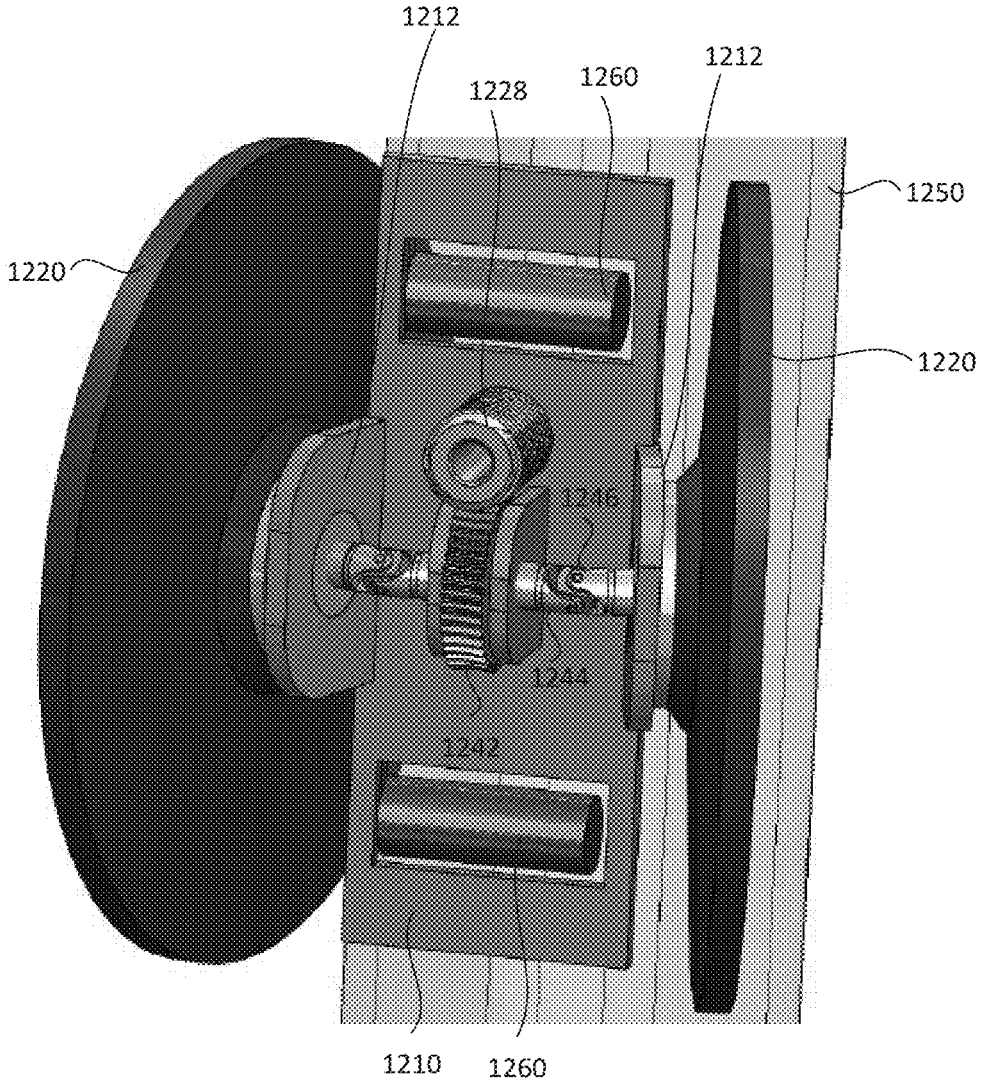
FIG. 14 substantially depicts a front view of the actuator of FIG. 12 with near-side components removed to show internal components of the actuator.

FIGS. 12 to 14 show an embodiment of an actuator that can be utilized in the systems and methods of the invention as described herein. The actuator 1200 includes a body 1210 that is the approximate width of a batter board 1250 (e.g. 2 inch), though the width may be adjustable to fit on different sized batter boards such as 2×4 inch, 1×4 inch, metal stakes, or other configurations. At each edge of the body 1210 there is a guide wheel 1220 supported in a flange mount 1212 that is angled outward relative to the body 1210 such that the wheels 1220 are similarly angled relative to the body 1210. The guide wheels 1220 are spaced apart by approximately the width of the batter board 1250 at the axles, but taper inwards towards the batter board 1250 such that the wheels are required to be flexed outwards to receive the batter board 1250. The resilience in the mounts then cause the guide wheels to engage the sides of the of the batter board 1250 such that rotation of the guide wheels 1220 cause the actuator to traverse the batter board. The guide wheels are stiff enough to clamp onto the batter board and maintain position and grip with tension.

The body 1210 supports a motor 1224, such as a servo motor or stepper motor, that is operatively connected to the guide wheels. Signal units 1230, 1232 include communications modules that are able to communicate with the main control unit 110 of the system 100 (FIG. 1). The signal units 1230, 1232 are able to receive guidance commands from the main control unit and in response, operate the motor 1224 to turn the guide wheels 1220, thereby causing the actuator to traverse the batter board. One of the signal units (1232) stores programs to run the drivers i.e. interprets the commands sent by the main control unit. The other signal unit (1230) converts the voltage received from the first control unit (1232) into pulses that rotate the motor shaft.

FIG. 13 shows a side view of the actuator 1200 with one guide wheel 1220 removed to show the internal connection between the guide wheel 1220 and the motor 1224. The motor includes a drive axle 1226 that engages a drive gear 1228. The drive gear 1228 engages a cog 1242. Operation of the motor turns the drive axle 1226, the drive gear 1228 and the cog 1242.

FIG. 14 is a front view of the actuator with the motor 1224 and signal units 1230, 1232 removed. FIG. 14 shows that the guide wheels 1220 are each operatively connected to the cog 1242 by articulated axles 1244. The articulated axles 1244 include a bend joint 1246 between the centrally mounted cog 1242 and the angled mounts 1212 that allows for the angle between the mounts 1212 and the cog 1242. FIG. 14 further shows a set of contact rollers 1260 supported within the body of the actuator that space the body of the actuator from the batter board 1250 and allow free rolling of the actuator along the batter board.

While the embodiment of FIGS. 12-14 uses guide wheels 1220, other forms of guiding and movement systems may be used to both locate the actuator onto the batter board and to provide movement of the actuator along the batter board. In one alternative embodiment, a caterpillar drive system may be utilized. In a further alternative embodiment, a system of one or more rollers may be used.

Figure 15:
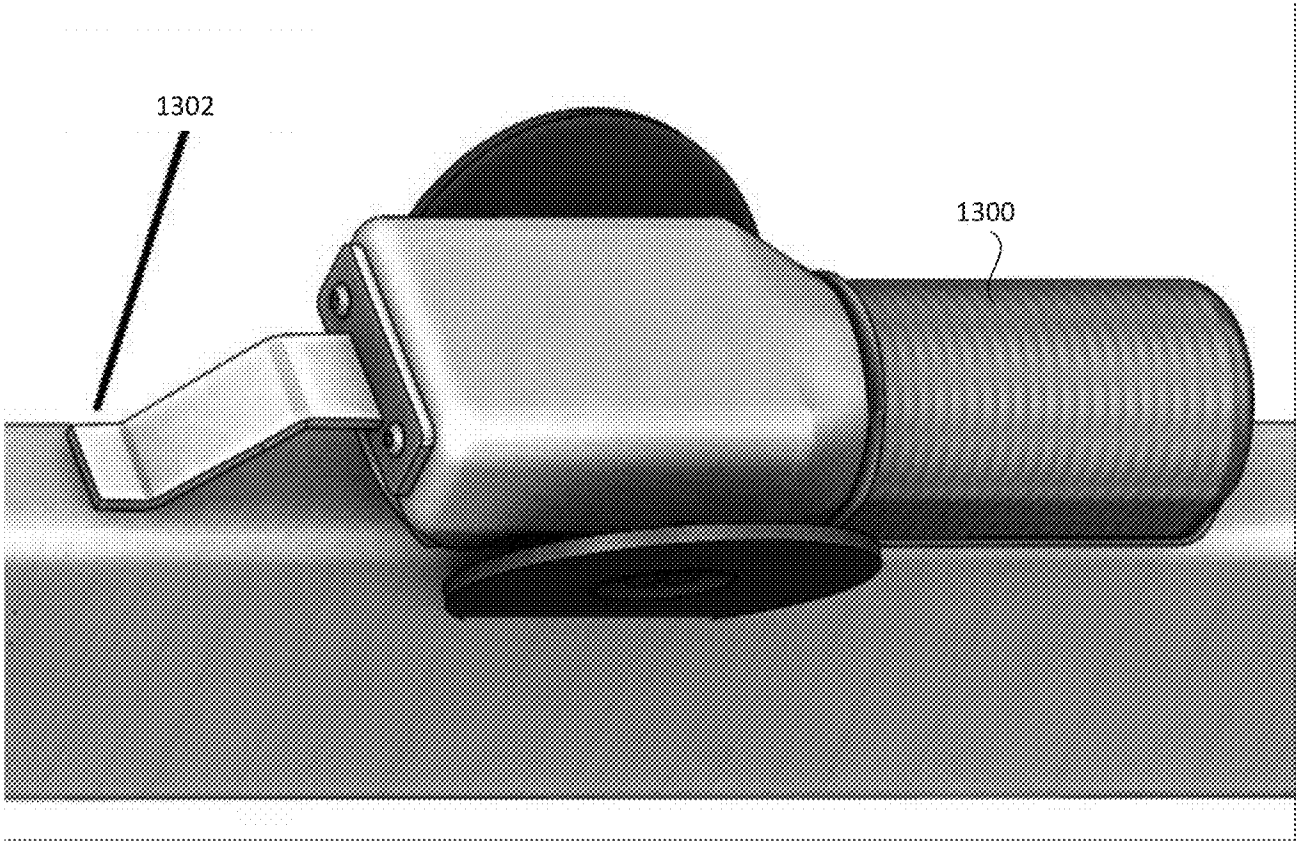
FIG. 15 substantially depicts a perspective view of an alternative embodiment of an actuator featuring bracket for mounting a marking device.

An embodiment of an actuator 1300 is depicted in FIG. 15. The actuator 1300 includes a mounting bracket 1302 that enables a marking apparatus to be mounted onto the actuator. The marking apparatus may be automatically driven or may be manually operated once the actuator indicates a required position on a board to be marked. The marking apparatus may be used to indicate the desired location and purpose/associated component of location indication at each step. Types of marking apparatus may include, without limitation, inkjet marking (including text), laser etching or engraving (including text), airbrush marking (including text), and/or placing a physical object (such as a nail or screw) driven into the batter board or foundation form board to indicate a desired location.

Figure 17:
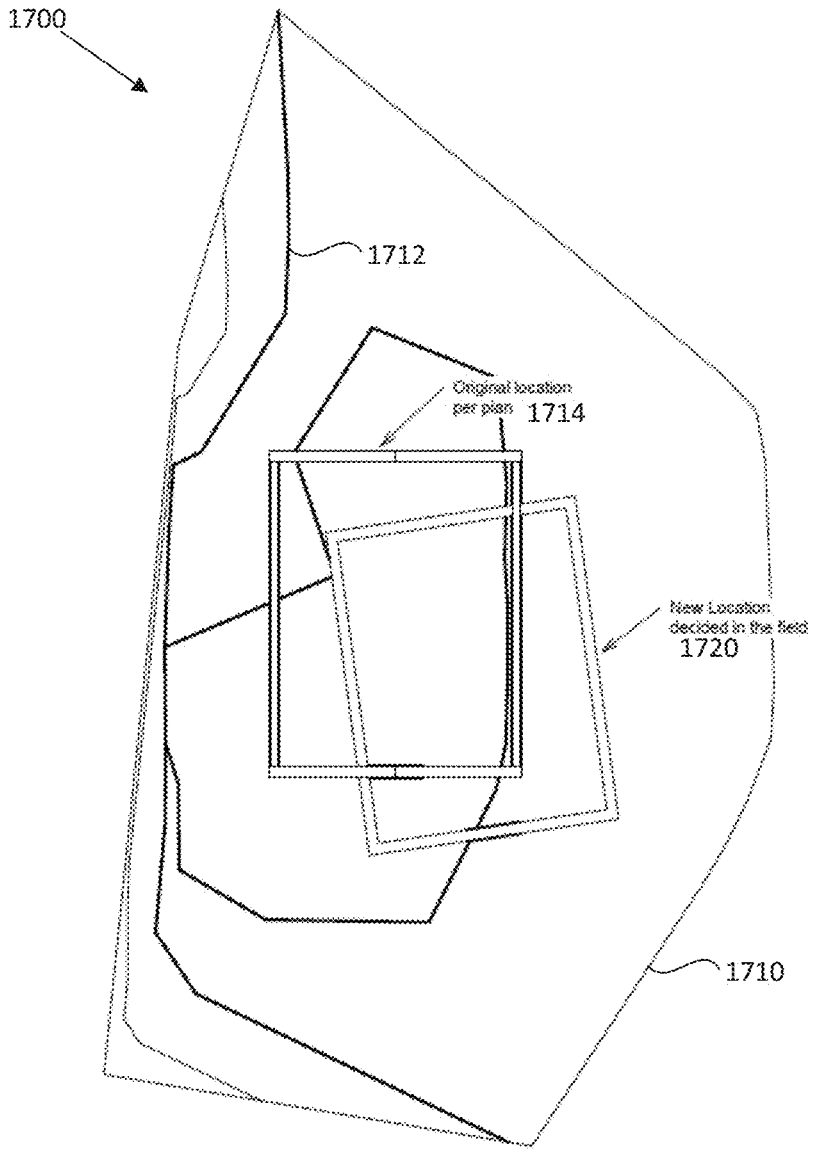
FIG. 17 substantially depicts a display of a graphic user interface that enables a building location to be shifted on a building site.

In one embodiment, the system may incorporate a live graphic user interface (GUI), e.g. as part of the control unit 210. The live GUI allows for real-time adjustments and updating of the location of the building on the building pad in the field. FIG. 17 shows a display 1700 of the GUI, The display shows an outline of a plot of land 1710 featuring contour lines 1712 and the original or planned location of a building 1714. The display allows the building to be selected and moved around to new locations 1720 positions on the plot display 1710. For example, the building may be rotated slightly or shifted to take better advantage of the available view scape. The GUI may display renderings of the available view from the doors/windows of the building, based on the location/angle of the building design correlated with sensor input. When the building location is locked in on the GUI, any adjustments to the building location/orientation may then inform the building orientation and corner locations through the laser pointer or augmented reality applications mentioned above. Updated plot plans can then be generated showing the new building location/orientation, based on the field data.

Figure 18:
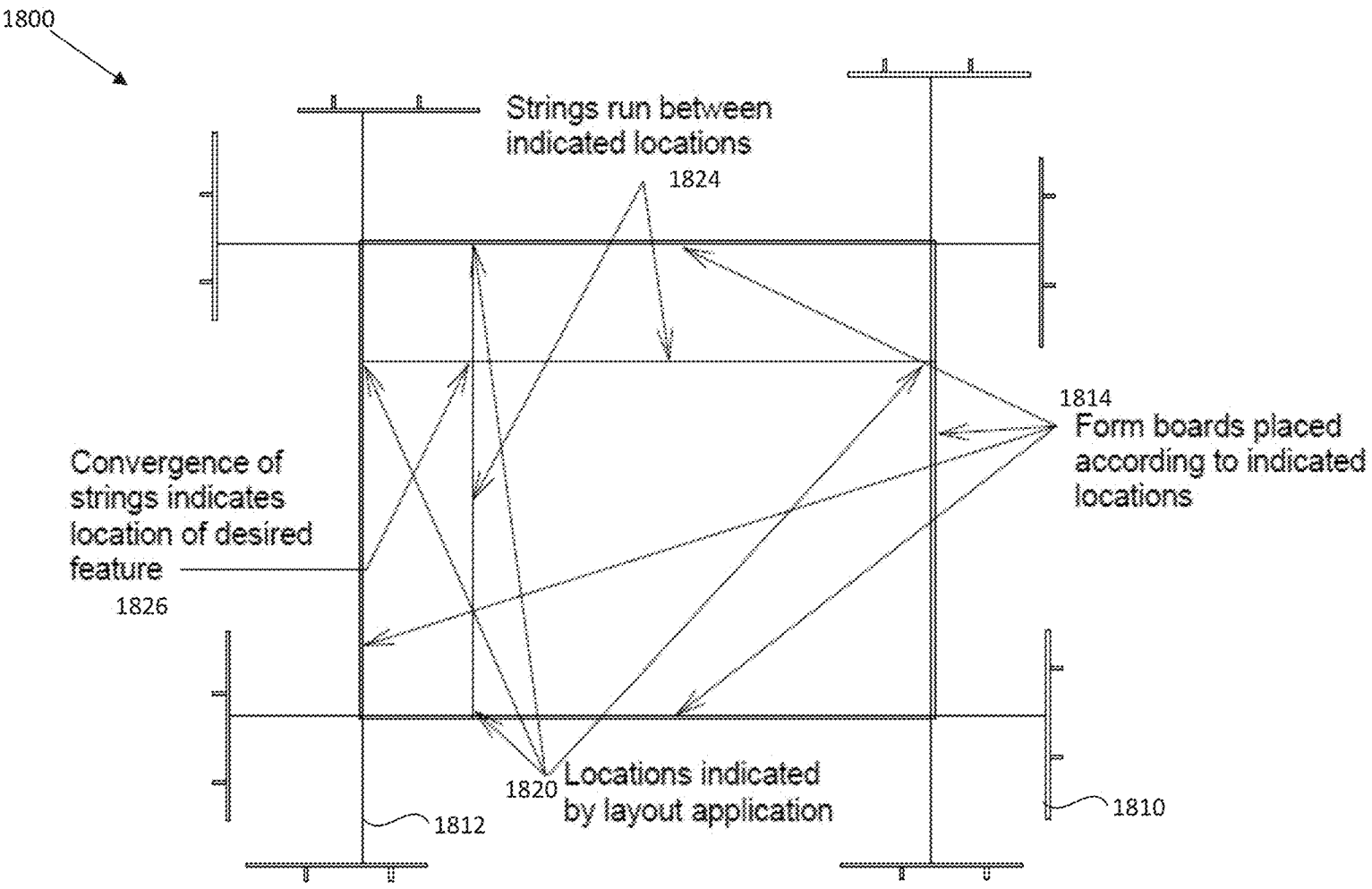
FIG. 18 substantially depicts indicating positions of features within the perimeter of form boards.

FIG. 18 shows how the system can be used to indicate locations of features not directly adjacent to foundation form boards. FIG. 18 shows a building layout 1800 featuring building extension batter boards 1810, foundation form board string lines 1812 and foundation form boards 1814 that indicate the edges of a building foundation. However, there may be additional features that are required on the site prior to the concrete pour such as a waste pipe or other conduits. To mark such features, the digital layout software may calculate locations on the form boards and/or batter boards for anchoring string lines. The locations are calculated such that string lines running between these marked points intersect at the desired location of the feature. FIG. 18 shows four string anchor locations 1820 marked on the form boards 1814. The anchor locations 1820 may be marked on the form boards 1814 at the building site by placing the marking actuator described previously onto the form boards 1824. The position of the actuator can then be controlled so indicate the required position of the string anchor location 1820. String lines 1824 may then be run between the anchor locations 1820. The point 1826 at which the strings 1824 intersect thereby marks the location of the feature.

Many modifications and other implementations of the disclosure set forth herein will come to mind to one skilled in the art to which this disclosure pertains having the benefit of the teachings presented in the foregoing descriptions and the associated drawings. Therefore, it is to be understood that the disclosure is not to be limited to the specific implementations disclosed, and that modifications and other implementations are intended to be included within the scope of the appended claims. Moreover, although the foregoing descriptions and the associated drawings describe example implementations in the context of certain example combinations of elements and/or functions, it should be appreciated that different combinations of elements and/or functions may be provided by alternative implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A method for building foundation layout, the method comprising:

(A) locating at least one moveable device onto a vertical batter board;

(B) providing a first guidance signal from a control unit to the at least one moveable device to move the at least one moveable device to indicate a height of a top of a building foundation;

(C) locating the at least one moveable device onto a horizontal batter board placed on the vertical batter board in alignment with the indicated height of the top of the building foundation; and (D) providing a second guidance signal to the at least one moveable device to move the at least one moveable device to indicate a position on the horizontal batter board where an extension of a building edge intersects the horizontal batter board.

2. The method of claim 1 wherein the control unit comprises a digital building layout comprising a site layout and a digital building model.

3. The method of claim 2 comprising scanning a building site to generate the site layout.

4. The method of claim 2 comprising scanning a building site that includes one or more vertical batter boards and incorporating a location of the one or more vertical batter boards into the digital building layout.

5. The method of claim 4 wherein the building site includes one or more form boards, the method comprising scanning the building site and incorporating a location of the one or more form boards into the digital building layout.

6. The method of claim 5 comprising comparing a scanned location of the form boards with an intended location of the form boards on the digital building layout to determine the accuracy of placement of the form boards at the building site.

7. The method of claim 5 comprising:

(A) locating the at least one moveable device on at least one of the one or more foundation form boards;

(B) determining a location of a feature within a boundary defined by the one or more foundation form boards;

(C) determining locations of anchor points on the one or more foundation form boards for string lines that intersect at the location of the feature;

(D) providing a third guidance signal to the at least one moveable device to move the at least one moveable device to indicate the position of an anchor point on the one or more foundation form boards.

8. The method of claim 1 wherein the control unit is programmed to detect the position of the at least one moveable actuator.

9. A moveable device for use in laying out a building foundation, the moveable device comprising:

(A) one or more guides for locating the moveable device on a batter board;

(B) a motor for driving the one or more guides to cause the moveable device to move along the batter board;

(C) at least one signal unit that receives guidance signals and controls the motor in response to the guidance signals.

10. The moveable device of claim 9 including an indicator for indicating a position on the batter board.

11. The moveable device of claim 9 wherein the one or more guides comprise at least two guide wheels, wherein the at least two guide wheels are configured to grip a batter board between them.

12. The moveable device of claim 9 comprising a mounting bracket for mounting a marking device to the moveable device.

13. A system for building foundation layout, the system comprising:

(A) a control unit;

(B) one or more moveable position indicating devices that can be deployed onto batter boards located on a building site, wherein the one or more moveable position indicating devices is configured to:

(a) be located onto a vertical batter board;

(b) receive a first guidance signal from the control unit;

(c) move along the vertical batter board in response to the first guidance signal to a position that indicates a height of a top of a building foundation;

(d) be located onto a horizontal batter board placed on the vertical batter board in alignment with the indicated height of the top of the building foundation;

(e) receive a second guidance signal from the control unit; and (f) move long the horizontal batter board in response to the second guidance signal to a position on the horizontal batter board that indicates where an extension of a building edge intersects the horizontal batter board.

14. The system of claim 13 comprising one or more sensors deployable onto the building site and configured to scan a building site to generate a site layout that is stored in the control unit wherein the control unit further stores a digital building model.

15. The system of claim 14 wherein the control unit is configured to incorporate scanned locations of the batter boards into a digital building layout comprising scanned site data and the digital building model.

16. The system of claim 15 wherein the control unit is configured to incorporate scanned locations of form boards located on the building site into the digital building layout.

17. The system of claim 16 wherein the control unit is configured to compare a scanned location of the form boards with an intended location of the form boards on the digital building layout to determine the accuracy of placement of the form boards at the building site.

18. The system of claim 16 wherein at least one of the one or more moveable position indicating devices is configured to be disposed on at least one of the foundation form boards, wherein the control unit is configured to:

(A) determine a location of a feature within a boundary defined by the foundation form boards;

(B) determine locations of anchor points on the one or more foundation form boards for string lines that intersect at the location of the feature; and (C) provide a third guidance signal to at least one of the one or more moveable position indicating devices to move the at least one of the one or more moveable position indicating devices to indicate the position of an anchor point on the one or more foundation form boards.

19. The system of claim 13 wherein the control unit is programmed to detect the position of the at least one moveable actuator.

20. A moveable device for use in laying out a building foundation, the moveable device comprising:

(A) guide means for locating the moveable device on a batter board;

(B) motor means for driving the guide means to cause the moveable device to move along the batter board;

(C) signal means for receiving guidance signals and controlling the motor means in response to the guidance signals.

21. The moveable device of claim 20 including indicator means for indicating a position on the batter board.

22. The moveable device of claim 20 wherein the guide means comprises at least two guide wheels, wherein the at least two guide wheels are configured to grip a batter board between them.

23. The moveable device of claim 20 comprising mounting means for mounting a marking device to the moveable device.

* * * * *